United States Patent [19]

Behenna et al.

[11] 3,955,114

[45] May 4, 1976

[54] MAGNETICALLY FOCUSED ELECTRON BEAM TUBE

[75] Inventors: Joshua J. Behenna, Brixham; Graham Harold George Phipps, Totnes, both of England

[73] Assignee: International Standard Electric Corporation, New York, N.Y.

[22] Filed: June 21, 1974

[21] Appl. No.: 483,854

[30] Foreign Application Priority Data

July 10, 1973 United Kingdom ..... 32781/73

[52] U.S. Cl. ..... 313/36; 313/156; 313/257; 313/289; 313/293

[51] Int. Cl.[2] ..... H01J 7/26

[58] Field of Search ..... 313/36, 156, 193, 293, 313/256, 257, 289

[56] References Cited

UNITED STATES PATENTS

| | | | |
|---|---|---|---|
| 2,189,593 | 2/1940 | Putzer | 313/257 |
| 2,805,361 | 9/1957 | Brown | 313/36 X |
| 3,327,156 | 6/1967 | Gerlach | 313/256 X |
| 3,354,340 | 11/1967 | Almer et al. | 313/257 X |

FOREIGN PATENTS OR APPLICATIONS

| | | |
|---|---|---|
| 1,195,703 | 6/1970 | United Kingdom |

*Primary Examiner*—R. V. Rolinec
*Assistant Examiner*—Darwin R. Hostetter
*Attorney, Agent, or Firm*—John T. O'Halloran; Menotti J. Lombardi, Jr.

[57] ABSTRACT

A magnetically focused coaxial triode structure includes a central longitudinal cathode, an intermediate control electrode around the cathode, and an outer tubular anode. The control electrode supports the inner cathode and is mounted on insulating spacers at the ends. Axial transverse slots along the control electrode provide openings for the electron beam. The anode has flat longitudinal water cooling channels connected by annular recesses at the ends.

6 Claims, 2 Drawing Figures

MAGNETICALLY FOCUSED ELECTRON BEAM TUBE

BACKGROUND OF THE INVENTION

1. Field of the Invention

This invention relates to magnetically beamed power tubes and particularly to an improved electron beam magnetically focused power tube of a coaxial triode structure.

2. Description of the Prior Art

Magnetically focused electron beam tubes of a planar structure have been previously described in British Patent No. 1,195,703.

SUMMARY OF THE INVENTION

The primary object of the present invention is to provide an improved magnetically focused electron beam tube having a coaxial triode structure.

The magnetically beamed power tube of the present invention includes a cylindrical anode, an elongate cathode extending along said anode and a rigid elongate conductive member extending along said anode between said cathode and anode, said member forming both a control electrode and a main structural support member supporting the cathode via intermediate insulating spacers. In order that the invention can be clearly understood reference will now be made to the accompanying drawings.

DESCRIPTION OF THE PREFERRED EMBODIMENT

Figure 1:
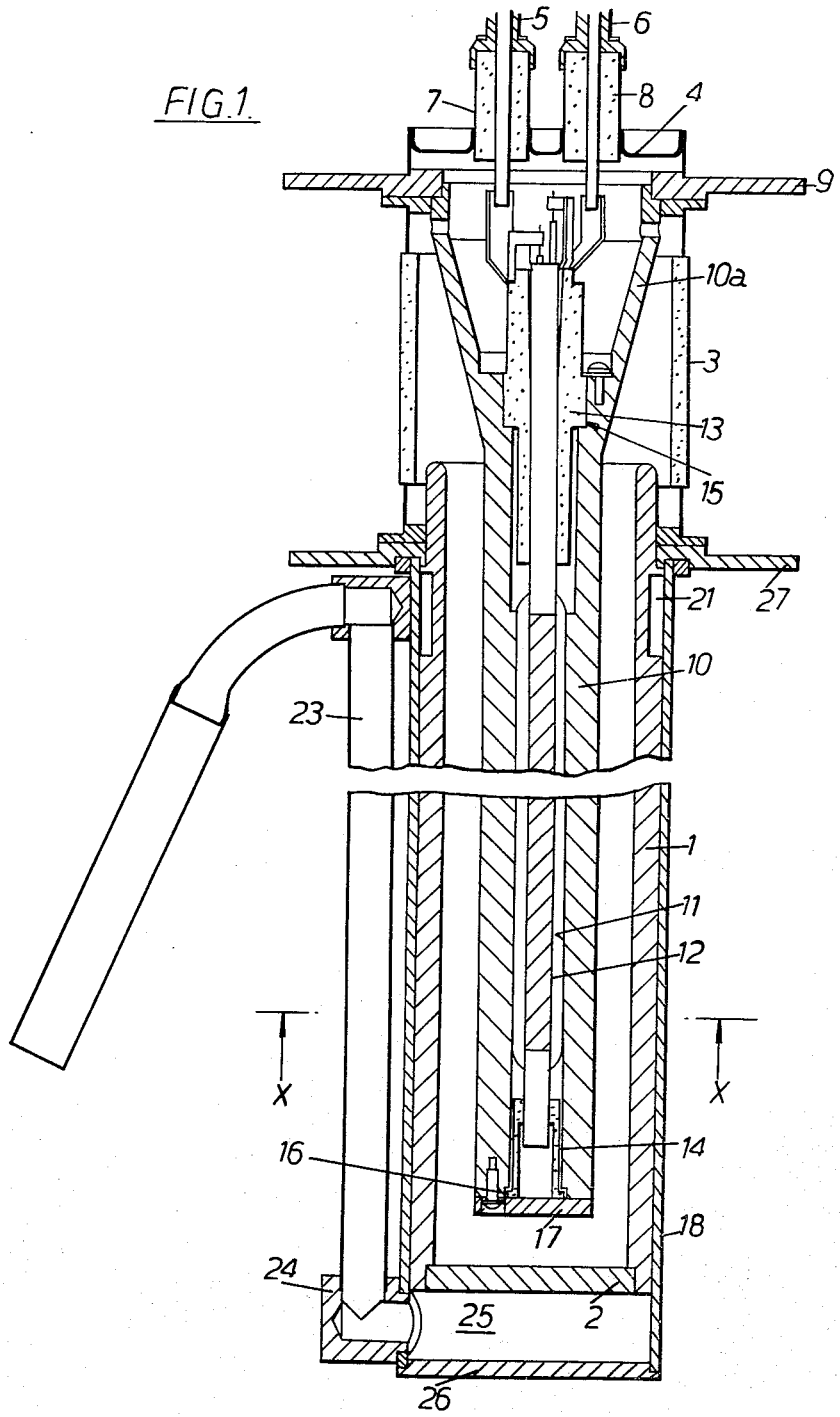
FIG. 1 is an axial cross-section of a six kW magnetically beamed triode in accordance with an embodiment of the invention.

The electron beam tube comprises an evacuated envelope formed by an elongate anode 1 which is cylindrical and made of copper and closed by an end cap 2, a cylindrical alumina portion 3 and a base cap 4. The base cap 4 supports heater terminal 5 and heater-cathode terminal 6 via insulating members 7 and 8 respectively. Base cap 4 is joined to a stainless steel or other non-magnetic material gate flange 9 to which is secured one end of the alumina part 3 and one end also of a gate or control electrode structure 10 of rod-like form and conveniently made of copper.

The structure 10 has a flared hollow base portion 10a and an axially extending transverse slot 11. A cathode 12 extends along and within the slot 11 and is supported by the gate electrode structure 10, this structure forming a main structural support member for the cathode via intermediate insulating spacers 13 and 14 which are tubular and made of alumina. Spacer 13 is located in a recess 15 and spacer 14 is located in a recess 16 in the gate structure 10 adjacent each end of the slot 11. The spacer 14 is a guide member for that end of the cathode and is held in place by a gate end cap 17.

Figure 2:
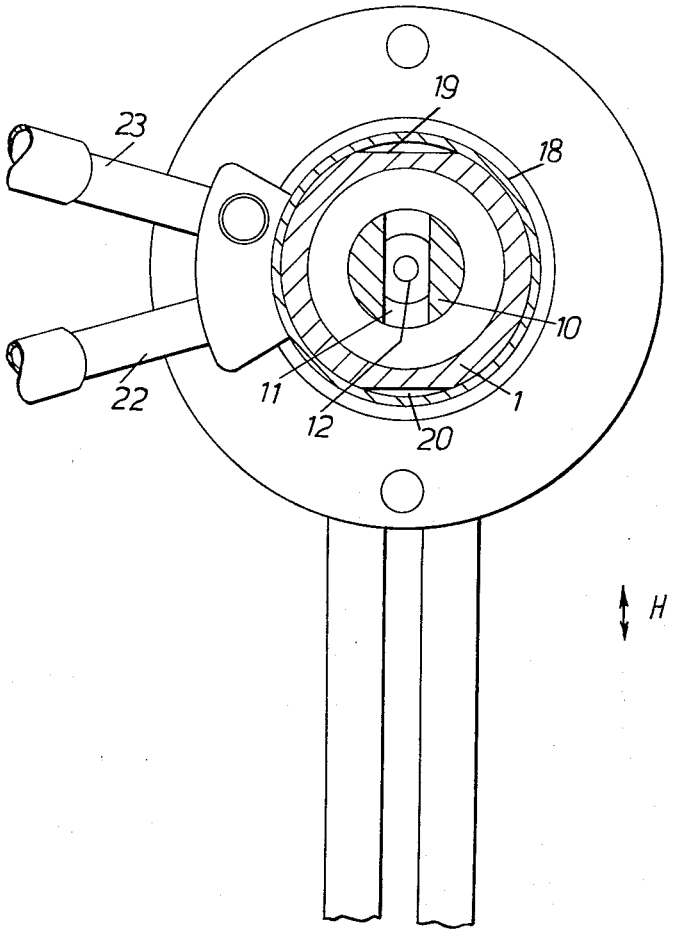
FIG. 2 is a section along the line X—X of FIG. 1.

The anode 1 has an outer sleeve 18 closely embracing it and also has two water coolant channels 19 and 20 defined between the casing 18 and diametrically opposed flats on the outer surface of the anode 1. These channels are opposite the slot 11 (see FIG. 2). An annular recess 21 communicates with both channels 19 and 20 and also with a water access pipe 22 via a port (not shown) in the casing 18 in the region of the recess 21. A second fluid access port 23 communicates via a connector 24 with a coolant chamber 25 defined between the anode end cap 2 and a casing end cap 26, this chamber communicating with the opposite ends of the channels 19 and 20. Thus water fed in through pipe 23 will circulate to chamber 25 and up through the channels 19 and 20 to the recess 21 and back to the supply via access pipe 22.

In the embodiment described the cathode 12 is held fairly firmly by the spacer 13 and is merely guided in the spacer 14 to maintain a correct spatial relationship with the gate structure 10 and allows for differential thermal expansion. An anode connecting flange 27 is connected between the anode and casing on the one hand and the cylindrical alumina envelope portion 3 on the other hand.

It can be seen that the valve has a simple electrode structure, in particular the control or gate electrode performs the additional function of a main structural support member supporting the cathode via the intermediate insulating spacers 13 and 14. A magnetic field would be applied (in a direction normal to the plane of the paper in FIG. 1 and in a north-south direction in FIG. 2) to direct the electron beam from the cathode to the anode through the slot 11.

What is claimed is:

1. A magnetically focused electron beam power tube comprising a tubular anode, a cathode extending axially in the anode and a rigid elongate conductive member extending axially in the anode between said anode and cathode, said member forming both a control electrode and a main structural support member for said cathode, intermediate insulating spacers between said cathode and control electrode, said spacers physically supporting said cathode from said control electrode, one of said spacers allowing differential thermal expansion between the cathode and the control electrode, and means for applying potential between said anode, control electrode and cathode to form an electron beam, said control electrode having a transverse slot extending axially on opposite sides of said cathode for directing said electron beam from said cathode toward opposite sides of said anode said anode being a single integral electrode surrounding said control electrode and cathode.

2. The electron tube according to claim 1, wherein said cathode is a rod extending along and within said slot.

3. The electron tube according to claim 2, wherein said member includes a recess adjacent each end of said slot, said intermediate insulating spacers being housed at least partially in said recesses.

4. The electron tube according to claim 1, wherein the anode is cylindrical.

5. A magnetically focused electron beam power tube comprising a cylindrical anode, an elongated control electrode projecting from one end of said tube and extending axially within the anode, said control electrode having an axially-extending transverse slot therein providing an opening for an electron beam, a cathode mounted within said slot and having intermediate insulating spacers between said cathode and control electrode, said spacers physically supporting said cathode from said control electrode, one of said spacers allowing differential thermal expansion between the cathode and the control electrode, means applying potential between said anode, control grid and cathode to form said electron beam, said slot being on opposite sides of said cathode for directing said electron beam from said cathode toward opposite sides of said anode, said anode being a single integral electrode, and a cylindrical jacket enclosing said anode and having diagonally opposed coolant channels positioned opposite said slot between said anode and jacket.

6. The electron tube according to claim 4, wherein said anode has a flat formed thereon and is encased in an outer sleeve, the space between said flat and said sleeve forming an axially extending coolant channel between said sleeve and anode.

* * * * *